US006640581B1

(12) United States Patent
Choi

(10) Patent No.: US 6,640,581 B1
(45) Date of Patent: Nov. 4, 2003

(54) PROPERTY BOX OF CABINET/WALL-HANGING TYPE REQUIRING LOW TEMPERATURE

(75) Inventor: Moon Choi, Namyangju (KR)

(73) Assignee: Yoo-Pyung Corporation, Seoul (KR)

( * ) Notice: Subject to any disclaimer, the term of this patent is extended or adjusted under 35 U.S.C. 154(b) by 0 days.

(21) Appl. No.: 10/111,679

(22) PCT Filed: Oct. 26, 2000

(86) PCT No.: PCT/KR00/01209

§ 371 (c)(1),
(2), (4) Date: Apr. 26, 2002

(87) PCT Pub. No.: WO01/31269

PCT Pub. Date: May 3, 2001

(30) Foreign Application Priority Data

| | | |
|---|---|---|
| Oct. 28, 1999 | (KR) | 1999-23360 |
| Oct. 28, 1999 | (KR) | 1999-23361 |
| May 29, 2000 | (KR) | 2000-15168 |
| May 29, 2000 | (KR) | 2000-15169 |
| May 29, 2000 | (KR) | 2000-15170 |

(51) Int. Cl.[7] ..... F25D 11/00

(52) U.S. Cl. ..... 62/440; 62/180; 62/215; 62/229; 62/441; 62/457.1; 62/249; 62/457.5

(58) Field of Search ..... 62/180, 213, 229, 62/440, 441, 457.1, 457.5, 249

(56) References Cited

U.S. PATENT DOCUMENTS

| | | | | |
|---|---|---|---|---|
| 3,948,410 A | | 4/1976 | Anderson | 220/9 G |
| 4,021,213 A | * | 5/1977 | Neidhardt et al. | 62/180 |
| 4,297,850 A | | 11/1981 | Reed | 62/3 |
| 4,331,690 A | * | 5/1982 | Bradshaw | 426/233 |
| 4,453,690 A | | 6/1984 | Takeuji | 248/309.1 |
| 4,689,965 A | * | 9/1987 | Janke et al. | 62/155 |
| 4,870,735 A | * | 10/1989 | Jahr, Jr. et al. | 29/157.3 |
| 5,347,827 A | | 9/1994 | Rudick et al. | 62/440 |
| 6,327,871 B1 | * | 12/2001 | Rafalovich | 62/434 |
| 6,374,621 B1 | * | 4/2002 | Berchtold | 62/114 |
| 6,378,324 B1 | * | 4/2002 | Percy et al. | 62/448 |
| 6,412,286 B1 | * | 7/2002 | Park et al. | 62/3.6 |

FOREIGN PATENT DOCUMENTS

| | | | |
|---|---|---|---|
| GB | 2 173 584 A | 10/1986 | F25D/11/00 |

* cited by examiner

*Primary Examiner*—William C. Doerrler
*Assistant Examiner*—Mark Shulman
(74) *Attorney, Agent, or Firm*—Fish & Richardson P.C.

(57) ABSTRACT

Disclosed is a property box of a cabinet/wall-hanging type requiring low temperature. The property box of a cabinet/wall-hanging type requiring low temperature according to the present invention provides advantages of being attachable to a wall surface or a corner of living space such as a bedroom of a married couple, a dress room or a bathroom in a newly-built or an existing apartment, an ordinary house or in lodging so as to store and make easily available of cosmetics, pharmaceuticals, films, beverage, beer or wine requiring low temperature whenever necessary. When protection of a privacy is required, unlike the conventional refrigerator shared by others in a shared living space, the property box according to the present invention can be installed at a desired position, thereby achieving the protection of privacy and resolving the problem of narrowing the living space subsequent to installation of the property box.

22 Claims, 13 Drawing Sheets

PROPERTY BOX OF CABINET/WALL-HANGING TYPE REQUIRING LOW TEMPERATURE

TECHNICAL FIELD

The present invention relates to a property box of cabinet/wall-hanging type requiring low temperature, and more particularly to a property box of cabinet/wall-hanging type requiring low temperature, which comprises an air cooler and is attachable to a wall surface or a corner of living space such as newly-built or existing apartments, houses or lodgings so as to store and make easily available of cosmetics, pharmaceuticals, films, beverage, beer or wine requiring low temperature whenever necessary.

BACKGROUND OF THE RELATED ART

Refrigerators are commonly used for the purpose of storing and avoiding degeneration of food for a long period of time at households or restaurants. In general, the refrigerators are manufactured in large size so as to store food requiring freezing or cooling in a massive scale. Such refrigerators are large in size and heavy in weight, thereby posing inconvenience in transportation and installation.

Also, since the refrigerators are conventionally installed in commonly shared space such as kitchens or living rooms, aesthetic factors can hardly be considered in the course of installation to be balanced with the surrounding circumstances within the living space. Moreover, cooked stuff, vegetables or meat requiring low temperature for the storage is stored together with pharmaceuticals, cosmetics, films in the same space at the same time. Therefore, a careless management of the cooling compartment is liable to result in insanitation due to a bad smell self-generated by the food and kinds of stuff stored therein.

It is the recent trend of living culture to avoid an exposure of a married couple's or an individual's private life to the extent of securing a bathroom for a couple's use only. Under these circumstances, it poses inconvenience for the one who desires to retain a nude state if he or she has to wear clothes and walking toward a refrigerator located in the shared living space for drinking water or beverage or making up one's face after taking a shower.

For this reason, a need has arisen to store pharmaceuticals, cosmetics or films requiring low temperature in a place apart from a refrigerator. Additional use of a small-sized refrigerator for that purpose rather result in narrowing the living space due to its extra occupation of a space despite its small size.

The problem of narrowing the living space is of significance when it comes to the lodgings or shops estimated about millions per square meter even if the space occupied by a small refrigerator is less than a square meter. It is apparent that the value of the occupied space is enormous. Accordingly, the most urgent task to be solved is to maximize the utility of a living space even if it is less than a square meter.

To solve the above problems, the applicant of the present invention filed Korean Patent Application No. 99-30784 on Jul. 28, 1999 and Utility Model Application Nos. 99-15247 and 99-15249, which are dual applications of the patent application.

Referring to FIGS. 1 and 2, the above Korean patent application and utility model applications disclose a constitution, comprising a cabinet 1 formed on a wall surface of a living space such as an ordinary house or a lodging in a predetermined size; a frame 2 inserted into an inner surface of the cabinet 1, tightly fixed to have a receiving space of a predetermined size and an exit; an opening/closing door 5 coupled with a hinge formed on the frame 2 and having an air cooler 3 on a lower portion thereof so as to discharge cool air as well as a housing section 4 inwardly formed to house properties, characterized in that the frame 2 has a prominence and depression groove 6 on a rear surface thereof, and an guiding bracket 7 is formed on the wall surface so as to be slidably coupled therewith from a side surface thereof.

In the conventional property box constituted above, cool air is generated by the air cooler 3 installed at the lower portion of the opening/closing door 5 so as to be supplied to the housing section 4. The cool air supplied from the air cooler 3 is discharged to a cool air discharge hole 9 along a cool air path 8.

The cool air discharged to the cool air discharge hole 9 is directly transferred to each housing section 4 formed in the opening/closing door 5 so that the properties (film, cosmetics, beverage, etc.) requiring cool air can maintain a predetermined temperature.

However, the property box 10 described above has drawbacks. To be specific, due to a formation of the air cooler 3 at the lower portion of the opening/closing door 5, frequent opening and closing of the opening/closing door 5 generate minute shakes transferred to and accumulated in the air cooler. This impedes a smooth operation of the air cooler when used for a long period of time or when exposed to a high humidity such as in a bathroom. Therefore, a continuous exposure to a high humidity may drive the property box into an abnormal operation, thereby deteriorating a quality of the product.

Furthermore, formation of the air cooler 3 in the opening/closing door 5 is also liable to cause a loss of heat due to a mixture of the cool air generated from the air cooler with the air from outside. This results in a significant waste of electric power.

DISCLOSURE OF INVENTION

To solve the above problems, it is an object of the present invention to provide a property box, which can prevent transferring of a shock to the air cooler generated by frequent opening and closing of the opening/closing door, and can avoid a direct contact of the humidity with the air cooler even under a humid atmosphere such as in a bathroom.

Another object of the present invention is to maximize availability of the living space when installing a property box.

To achieve the above and other objects of the present invention, there is provided a property box, comprising: a cabinet frame 101 of a predetermined size formed on a wall surface of a living space such an apartment, an ordinary house or a lodging; a first housing main body 104*a* having a housing for being inserted into the cabinet frame 101 and a predetermined housing space 102 as well as an exit 103; a fist air cooler 105*a* received and coupled with a predetermined space on a lower portion of the first housing main body 104*a* to generate low temperature; a first cool air path 107*a* for linking at least one or more first cool air discharging outlet 106*a* formed on an inner wall of the housing space 102 to supply cool air generated from the first air cooler 105*a* to the housing space 102 with the first air cooler 105*a*; and a first opening/closing door 108*a* rotatably hinge-coupled with the exit 103 of the first housing main body 104*a* for receiving predetermined properties.

The first air cooler 105*a* preferably includes a cryogenic semiconductor 111 operated by a power supply applied from a power supply section (not shown in the drawings) for generating cool and hot air.

The first air cooler 105*a* preferably includes a compressor (not shown in the drawings), a capillary tube (not shown in the drawings), and a vaporizer (not shown in the drawings) so as to circulate a coolant in a predetermined freezing cycle.

The first opening/closing door 108*a* preferably includes at least one or more first receiving shelf 109*a* attachably and detachably installed on a front surface of the external side thereof for receiving predetermined properties.

The housing space 102 preferably includes a second receiving section 110*b* for receiving properties to be in optimal contact with the cool air discharged to the first cool air discharging outlet 106*a* of the first housing main body 104*a*.

The first air cooler 105*a* further includes a first collecting section 113*a* slidably coupled with a lower portion thereof for guiding and collecting water generated inside of the first air cooler 105*a* and the housing space 102 to a collecting hole 112.

The first air cooler 105 further includes an external casing 114 fixedly inserted into the cabinet frame 101 for fixedly coupling the first housing main body 104*a* with the internal housing space 102.

The first air cooler 105*a* preferably further includes a rib 120 formed at least one of an external surface or a rear surface of the external casing with a predetermined thickness.

The first air cooler 105*a* is preferably housed by and coupled with a predetermined upper region of the first housing main body 104*a* so that the cool air generated therefrom can be circulated within the housing space 102 in a convection manner.

BRIEF DESCRIPTION OF THE DRAWINGS

The above and other objects, features and advantages of the present invention will become more apparent from the following detailed description when taken in conjunction with the accompanying drawings, in which.

BEST MODE FOR CARRYING OUT THE INVENTION

Figure 1:
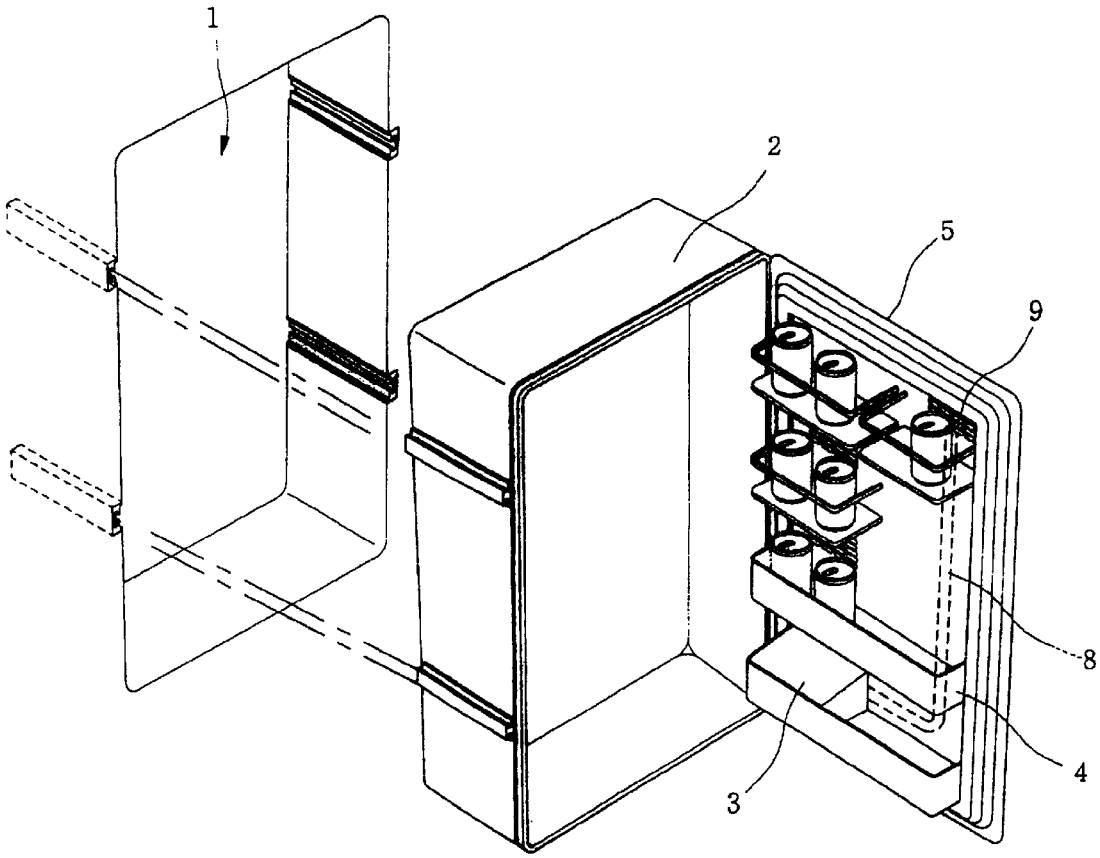
FIG. 1 is a view illustrating a rear construction of the conventional property box of a cabinet type.
Figure 2:
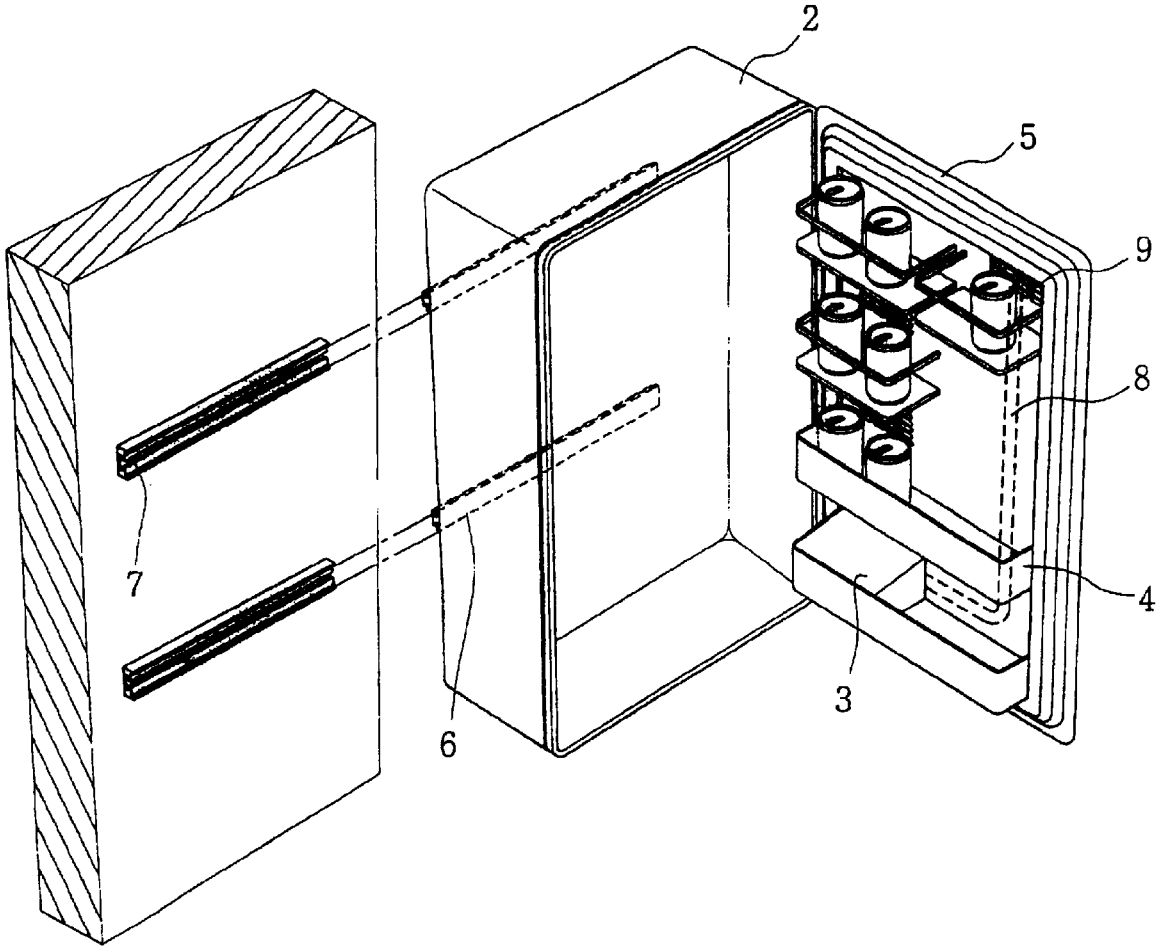
FIG. 2 is a view illustrating a front construction of the conventional property box of a wall-hanging type.

A best mode for carrying out the present invention will be described herein below with reference to the accompanying drawings. In the following description, well-known functions or constructions are not described in detail since they would obscure the invention in unnecessary detail.

The property box according to a best mode of the present invention comprises: a second housing main body 104*b* having a housing space 102 of a predetermined size and an exit 103; a second air cooler 105*b* coupled with a predetermined region of a lower portion of the second housing main body 104*b* for generating low temperature; a second cool air path 107*b* formed on an inner wall of the housing space 102 for linking at least one or more second cool air discharging outlet(s) 106 with the second air cooler 105*b* so as to supply the cool air generated from the second air cooler 105*b* to the housing space 102; a first opening/closing door 108*a* and a second opening/closing door 108*b* hinge-coupled with the exit 103 of the second housing main body 104*b* and having a first receiving section 110*a* inwardly thereof to receive predetermined properties; a first fixed bracket 115 of "I" shape attached to a rear surface of the second housing main body 104*b* in a longitudinal direction; and an guiding bracket 116 having a concave groove in a longitudinal direction so as to be slidably coupled with the first fixed bracket 115.

The second air cooler 105*b* preferably includes a second cryogenic semiconductor 111 for generating cool and hot air by being operated by the power supply applied from the power supply section.

Also, the second air cooler 105*b* preferably includes a compressor (not shown in the drawings), a capillary tube (not shown in the drawings), and a vaporizer (not shown in the drawings) for circulating a coolant in a predetermined freezing cycle.

The second air cooler 105 further includes a third receiving section 110*c* installed inside of the housing space 102 for receiving properties to be in optimal contact with the cool air discharged to the second cool air discharging outlet 106*b* of the second housing main body 104*b*.

The second air cooler 105*b* further includes a second collecting section 113*b* slidably coupled with a lower portion of the second air cooler 105*b* for guiding and collecting water generated inside of the second air cooler 105*b* and the housing space 102 to a collecting hole 112.

The second air cooler 105*b* is housed by and coupled with a predetermined upper region of the second housing main body 104*b* so that the cool air generated therefrom can be circulated within the housing space 102 in a convection manner.

The second air cooler 105*b* further includes a second fixed bracket having at least one or more latch(es) integrally or separately formed on either one of the upper or lower portion of the rear surface of the second housing main body 104*b* and an upwardly convex groove bolted on a wall surface for supporting the latch(es).

The second fixed bracket includes at least one or more plate(s) integrally or separately formed in a predetermined size. The second fixed bracket includes a sliding prevention section formed on either one of the sides of the second fixed bracket so that the latch(es) engaged with the second fixed bracket may not slide toward any one side thereof. Also, it is preferable to form the latch(es) in a longitudinal direction of the second housing main body. Subsequently, it is preferable to form the second fixed bracket in a longitudinal direction of the second housing main body so as to correspond to the latch(es). The second fixed bracket further includes at least one or more supporting member(s) formed on either one of the lower portion of the rear surface of the second housing main body or the wall surface contacted by the second housing main body.

The property box according to another best mode of the present invention comprises: a third housing main body 104*c* having a housing space 102 of a predetermined size so as to form a triangular shape and an exit on a front surface thereof; a third air cooler 105*c* coupled with a predetermined lower region of the third housing main body 104*c* for generating low temperature; a third cool air path 107*c* formed on an inner wall of the housing space 102 for linking at least one or more second cool air discharging outlet(s) 106*c* with the third air cooler 105*c* so as to supply the cool air generated from the third air cooler 105*c* to the housing space 102; a third opening/closing door 108*c* hinge-coupled with the exit 103 of the third housing main body 104*c*; a first fixed bracket 115 of "I" shape attached to both sides of a rear surface of the third housing main body 104*c* in a vertical direction; and an guiding bracket 116 having a concave groove in a longitudinal direction so as to be slidably coupled with the first fixed bracket 115 and is attached from a corner of the wall surface with a predetermined distance.

A construction of the present invention will now be described in detail with reference to FIGS. 3 to 13.

A cabinet frame 101 is formed in a predetermined size on a wall surface of a living space in an apartment, an ordinary house or a lodging. A first air cooler 105 is housed within a predetermined space at a lower portion of a first housing main body 104*a*, which is inserted into the cabinet frame 101 so that the cool air generated from the first air cooler 105 can be discharged to a first cool air discharging outlet 106*a* through a first cool air path 107*a*. A first opening/closing door 108*a* is hinge-coupled with an exit 103 of the first housing main body 104*a*.

The first air cooler 105*a* preferably includes either one of a cryogenic semiconductor 111 for generating cool and hot air by being operated by a power supply applied from a power supply section (not shown in the drawings) or an air cooler of a mechanical manner comprising a compressor (not shown in the drawings), a capillary tube (not shown in the drawings), and a vaporizer (not shown in the drawings) for circulating a coolant in a predetermined freezing cycle.

Figure 4:
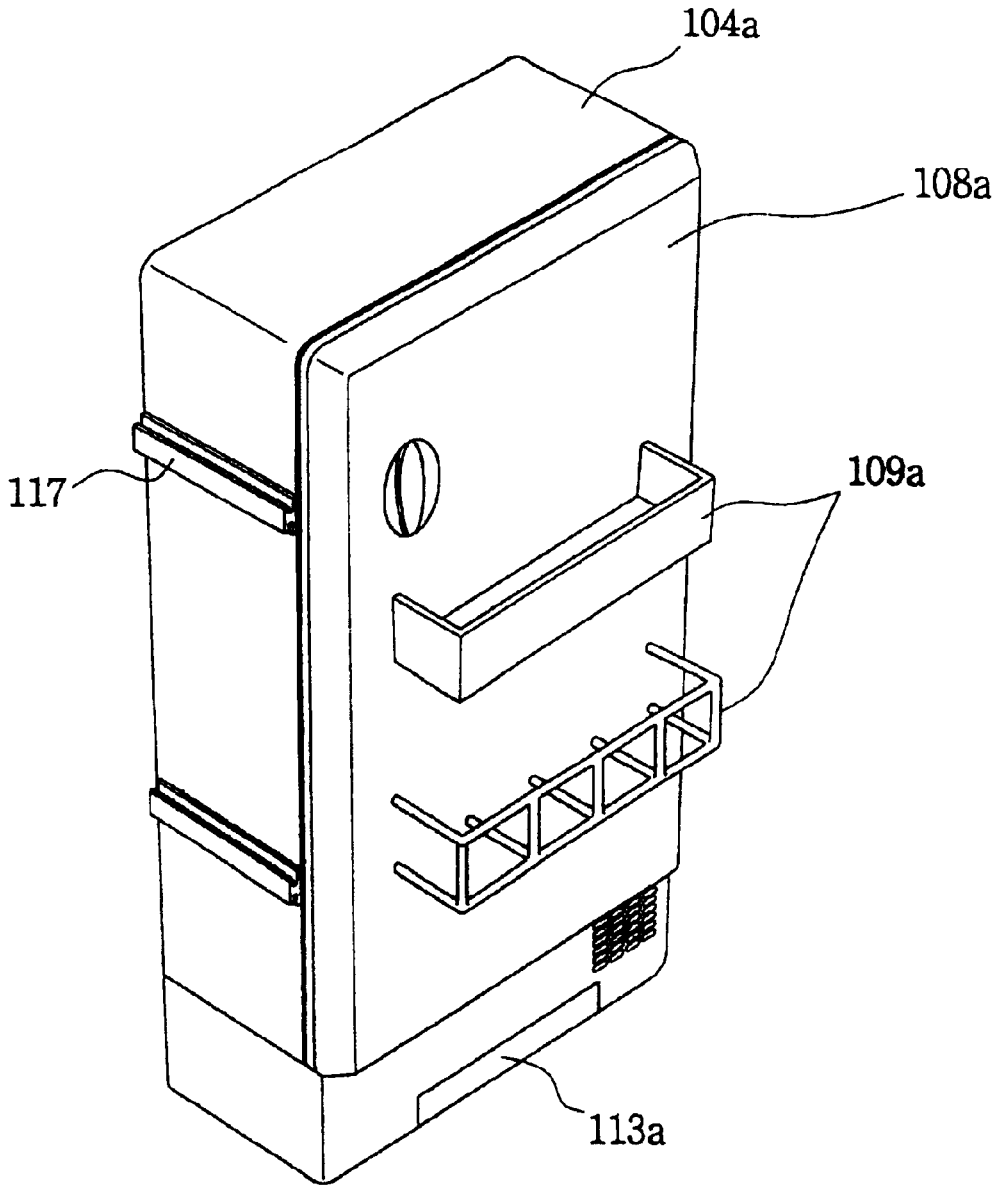
FIG. 4 is a perspective view illustrating an external appearance of the property box of a cabinet type according to the present invention.

As shown in FIG. 4, it is preferable to install at least one or more first receiving shelf (shelves) 109*a* for receiving predetermined properties on a front surface of the external side of the first opening/closing door 108*a*. A second receiving section 110*b* is annexed inside of the housing space 102 so that the cool air discharged to the first cool air discharging outlet 106*a* of the first housing main body 104*a* can be in optimal contact with the housed properties.

A first collection section 113*a* is coupled with the lower portion of the first air cooler 105*a* so as to be freely slidable for collecting water generated inside of the first air cooler 105*a* and the housing space 102 through a collecting hole 112.

Figure 3A:
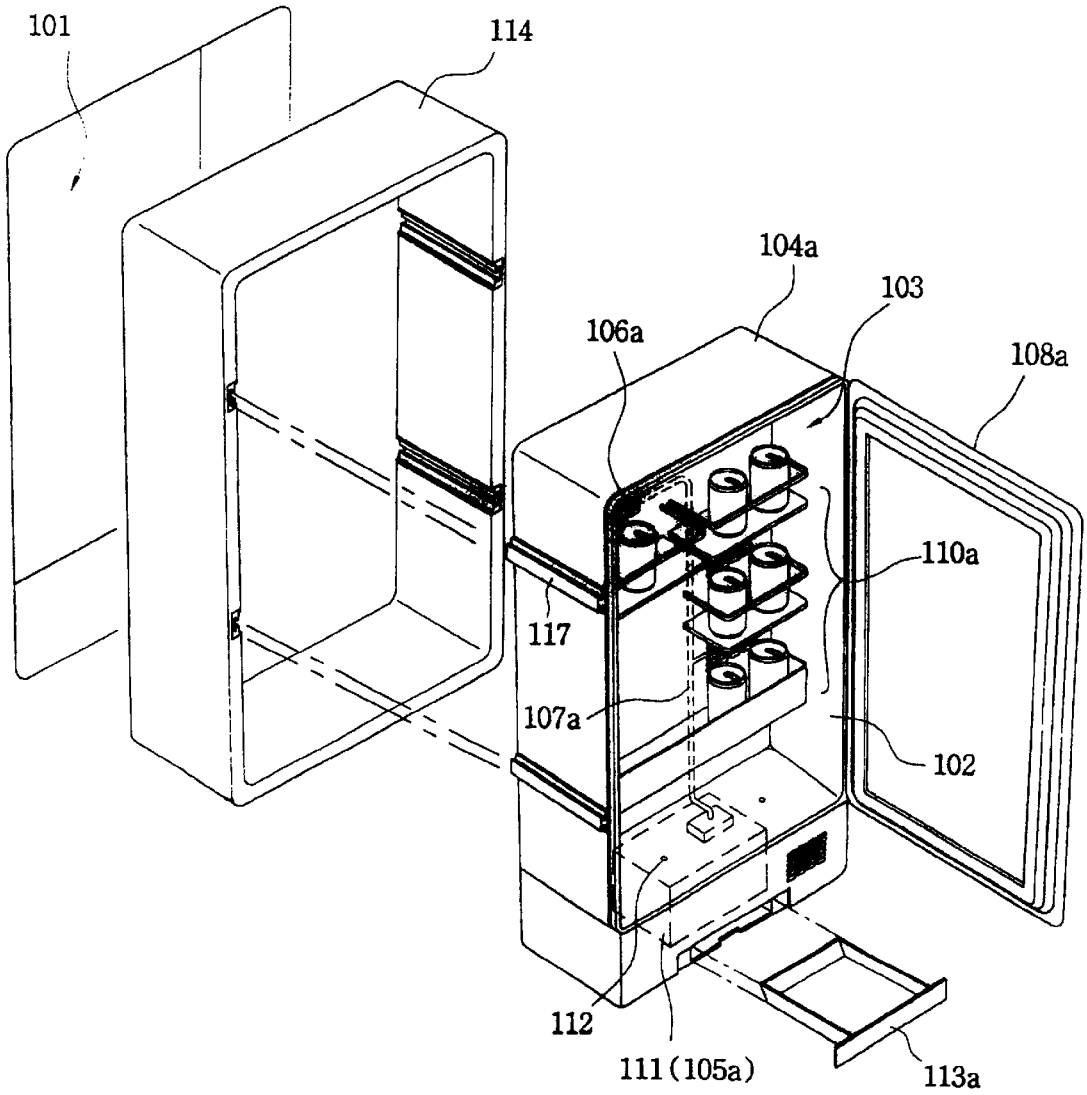
FIG. 3*a* is a view illustrating a comprehensive construction of a property box of a cabinet type according to the present invention.
Figure 3B:
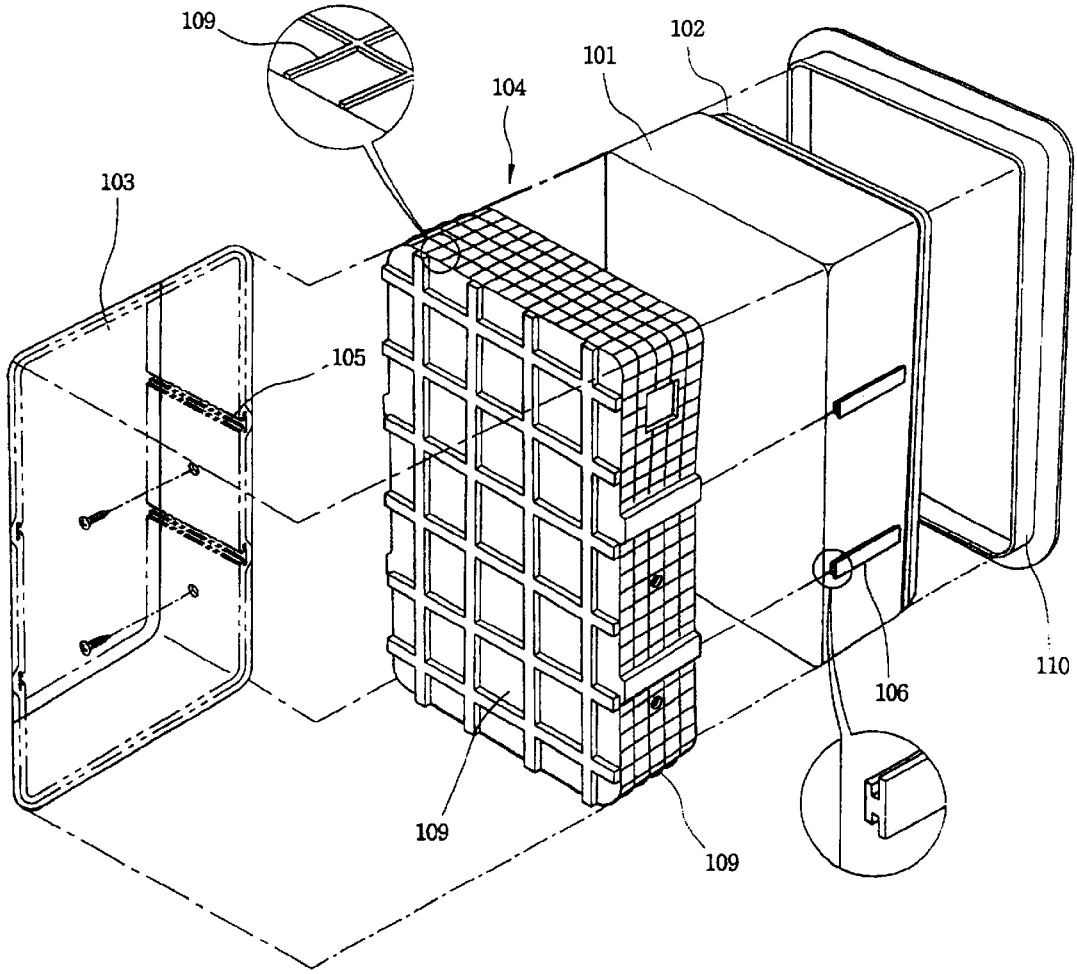
FIG. 3*b* is an enlarged view of a the property box of a cabinet type according to the present invention.

An external casing 114 having a predetermined housing space 102 is first fixedly coupled with the cabinet frame 101 before the first housing main body 104*a* is inserted thereinto, as shown in FIG. 3*a*, so that the first housing main body 104*a* can be firmly coupled with the cabinet frame 101. A rib 120 is formed on both side surfaces and a rear surface of the external casing 114, as shown in FIG. 3*b*, so that the cabinet frame 101 can retain the firm coupled state. To be specific, once after the rib 120 is inserted into the cabinet frame 101, mortar is attached to the external casing 114. By doing so, the adhesivity of the mortar is enhanced due to a rough surface formed by the rib 120, thereby preventing a detachment or separation of the mortar.

It is preferable to prevent deformation of the mortar even when in use or storage for a long period of time.

Figure 5:
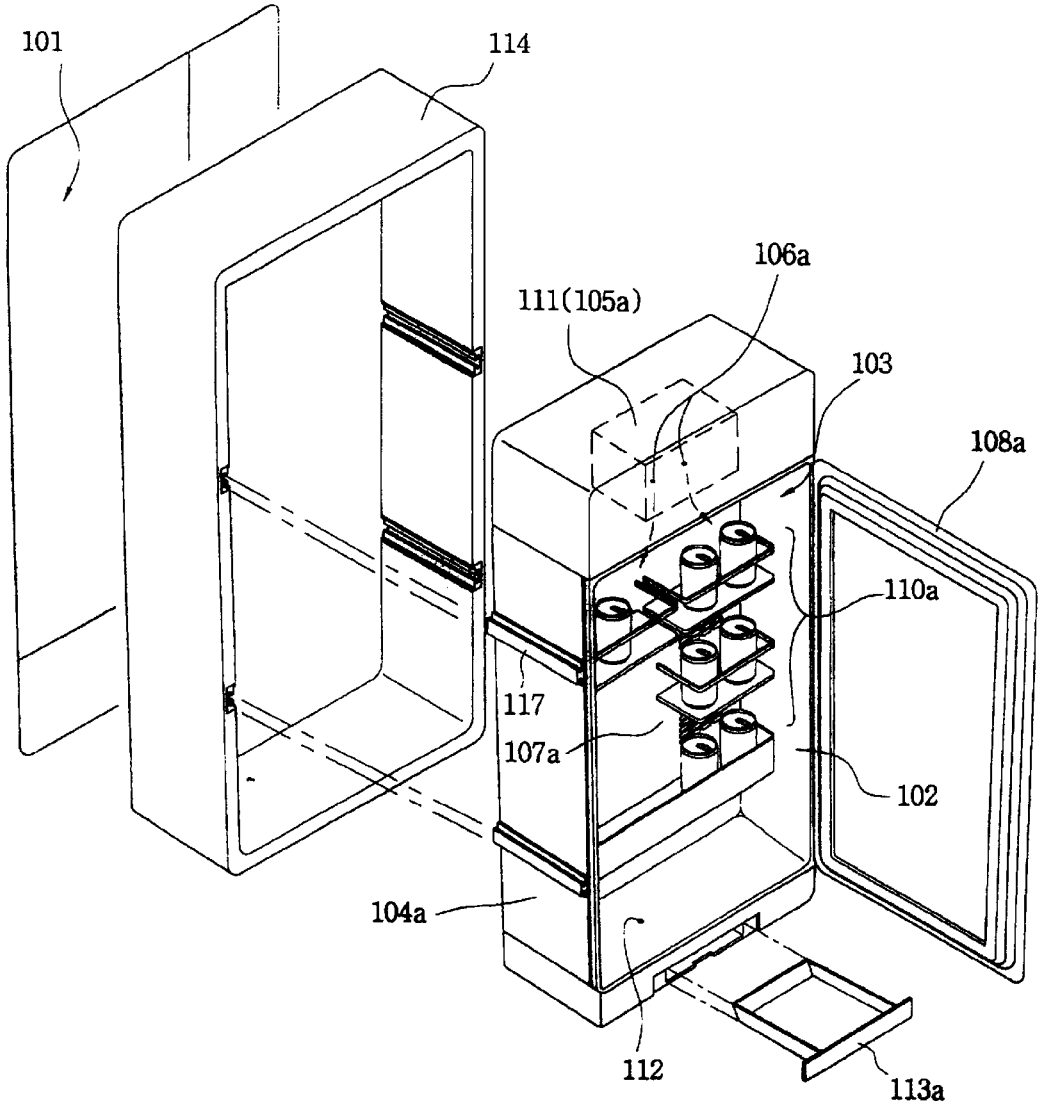
FIG. 5 is a view illustrating a best mode of the property box of a cabinet type according to the present invention.

As shown in FIG. 5, the fist air cooler 105*a* is housed in a predetermined upper region of the first housing main body 104*a* so that the cool air generated from the first air cooler 105*a* can be circulated in the housing space 102 in a convection manner.

In a best mode of the present invention, an guiding bracket 116 with a convex groove is attached to a wall surface in a longitudinal direction so as to be slidably coupled with a first fixed bracket 115 of "I" shape attached to a rear surface of the second housing main body in a longitudinal direction, thereby enabling an attachment of the property box on a wall surface without forming the cabinet frame 101 on the wall surface.

The second air cooler 105*b* is preferably either one of the electronic cooler generating cool and hot air by being operated with a power supply applied from the power supply section or a mechanical cooler comprising a compressor (not shown in the drawings), capillary tube (not shown in the drawings), and a vaporizer (not shown in the drawings) for circulating a coolant in a predetermined freezing cycle.

A third receiving section 110*c* is annexed inside of the housing space 102 of the second housing main body 104*b* so that the cool air discharged to the second cool air discharging outlet 106*b* of the second housing main body 104*b* can be in optimal contact with the housed properties.

A second collection section 113*b* is coupled with the lower portion of the second air cooler 105*b* so as to be freely slidable for collecting water generated inside of the second air cooler 105*b* and the housing space 102 through the collecting hole 112.

The second air cooler 105*b* is housed in a predetermined upper region of the second housing main body 104*b* so that the cool air generated from the second air cooler 105*b* can be circulated in the housing space 102 in a convection manner.

The second housing main body 104*b* has at least one or more latch(es) 121 integrally or separately formed on either one of the upper or lower portion of the rear surface thereof. A second fixed bracket 122 having an open convex groove is formed upwardly on the wall surface so as to support the latch(es).

It is preferable to form at least one or more second fixed bracket(s) 122 integrally or separately from a plate 127 of a predetermined size. The second fixed bracket(s) 122 preferably include(s) a sliding prevention section 124 formed on either one of the sides of the second fixed bracket so that the latch(es) 121 engaged with the second fixed bracket may not slide toward any one side thereof. Also, it is preferable to form the latch(es) 121 in a longitudinal direction of the second housing main body 104*b*. Subsequently, it is preferable to form the second fixed bracket(s) 122 in a longitudinal direction of the second housing main body 104*b* so as to correspond to the latch(es) 121.

It is preferable to include at least one or more supporting member(s) formed on either one of the lower portion of the rear surface of the second housing main body 104*b* or the wall surface contacted by the second housing main body 104*b* so as to be engaged with the wall surface with balance.

According to another best mode of the present invention, a third housing main body 104*c* is constructed in a triangular shape to have a housing space 102 of a predetermined size and an exit on a front surface thereof so that a property box can be attached to a corner where two wall surfaces encounter.

The technical features of the present invention constructed above will now be described in detail.

First, the first housing main body 104*a* is inserted to the cabinet frame 101 formed on a wall surface of a living space. Here, the cabinet frame 101 may be formed to penetrate a wall surface of one side through another wall surface of the other side depending on the wall-building convenience. Accordingly, as shown in FIGS. 3 and 5, the external casing 114 is first inserted to the cabinet frame 101 before inserting the housing main body 104. Then, mortar is attached to the external casing 114 so that the external casing 114 can be firmly engaged with the cabinet frame 101. A rib of a predetermined size is preferably formed on an external side surfaces (both side surfaces and a rear surface) of the external casing 114, as shown in FIG. 3*b* so that the mortar may not be detached from or peeled off the external casing 114 but be firmly attached thereto.

The first housing main body 104*a* is inserted to the housing space 102 of the external casing 114. A guiding bracket 116 is formed on both side surfaces inside of the external casing 114 so that a convex and concave coupling section 117 formed on both side surfaces of the first housing main body 104*a* can be slidably guided.

By inserting the first housing main body 104*a* to the cabinet frame 101, an installation of the property box according to the present invention can be simply completed. The first air cooler 105*a* housed on the lower portion of the first housing main body 104*a* is operated by applying a power supply to the installed property box, as shown in FIGS. 3 and 4. As described above, the first air cooler 105*a* comprises the cryogenic semiconductor 111 for dispersing cool air from one side and hot air from the other side by means of a power supply so that the cool air dispersed to the one side can be circulated within the housing space and a noise is notably reduced thereby.

When installed in a bedroom, the present invention provides a great advantage of not interrupting a sleeping of the user. The present invention also has a merit of manufacturing the first air cooler 105*a* in an ultra-light weight and an ultra-slim shape.

It is preferable to attachably and detachably install a first receiving shelf 109*a* on a front surface of the first opening/closing door 108*a* so as to receive predetermined properties such as towels, shavers, etc. in a simple and convenient manner.

If a power supply is applied to the cryogenic semiconductor 111, the cool air dispersed from one side thereof is discharged to the first cool air discharging outlets 106*a* along the cool air path 107*a*. As a consequence, the cool air discharged from the plurality of first cool air discharging outlets 106*a* is immediately contacted with the properties received by the second receiving section 110*b* formed in multiple steps. Such an optimal contact of the cool air with the properties serves to prevent a heat loss caused by a suspension and circulation of the cool air.

Further, moisture and water drops formed due to a dew point generated inside of the housing space 102 are guided to the water collecting hole 112 formed on a bottom surface inside of the housing space 102 so as to be collected by the first water collecting section 113*a* installed on a lower portion of the cryogenic semiconductor 111. Therefore, if a predetermined amount of water is collected by the first water collecting section 113*a*, the user should simply take out the first water collection section 113*a* to dispose of the water.

Constructing the first air cooler 105*a* with a compressor, a capillary tube, and a vaporizer serves to circulate a coolant in a predetermined freezing cycle and supply the cool air generated at that time to the housing space 102 of the property box, thereby realizing a storage of the properties under a predetermined temperature.

If the first air cooler 105*a* is housed into an upper portion of the first housing main body 104*a*, the cool air generated from the first air cooler 105*a* is supplied to the housing space 102 through the first cool air discharging outlet 106*a* formed on an upper portion of the first housing main body 104*a*, thereby achieving natural circulation of the cool air. Thus, no separate work performance is required to form the first cool air path 107*a*, and a manufacturing unit cost can be saved.

A best mode of the present invention will now be described in further detail.

The first fixed bracket 115 of "I" shape formed on a rear surface of the second housing main body 104*b* in a longitudinal direction and the guiding bracket 116 having a concave groove to be coupled with the first fixed bracket 115 are attached to a wall surface. The first fixed bracket 115 is slidably inserted to one end of the convex groove of the guiding bracket 116 so as to be coupled therewith. The second housing main body 104*b* can then be attached to the wall surface.

Figure 6:
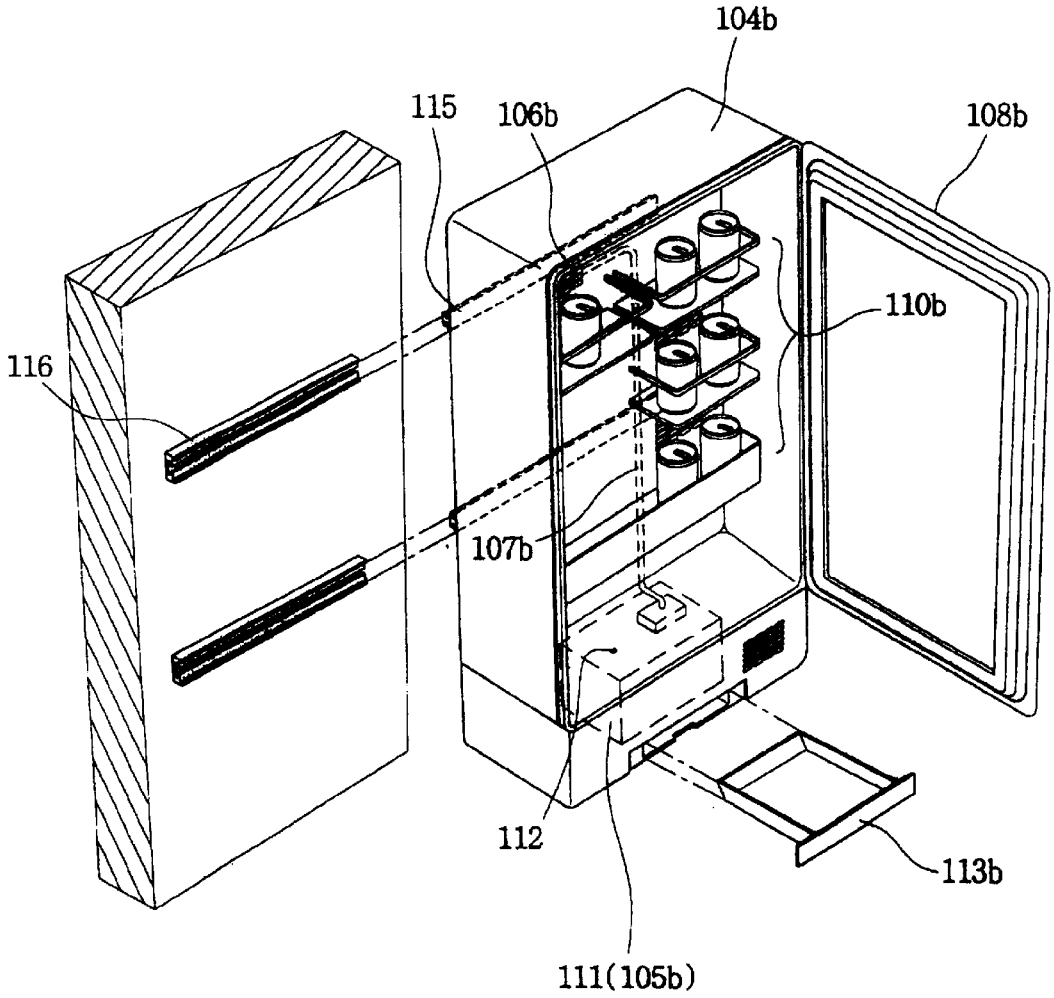
FIG. 6 is a view illustrating a comprehensive construction of the property box of a wall-hanging type according to the present invention.
Figure 7:
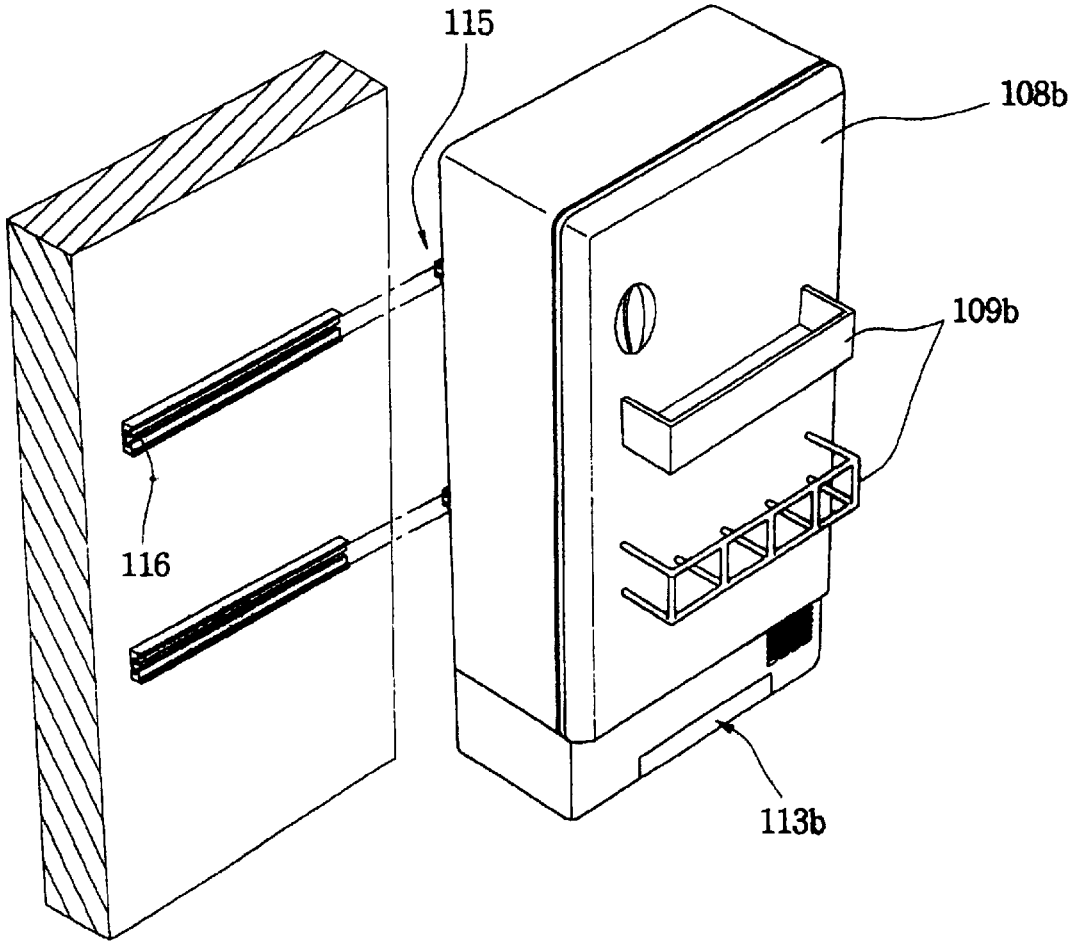
FIG. 7 is a view illustrating an external appearance of the property box of a wall-hanging type according to the present invention.
Figure 8:
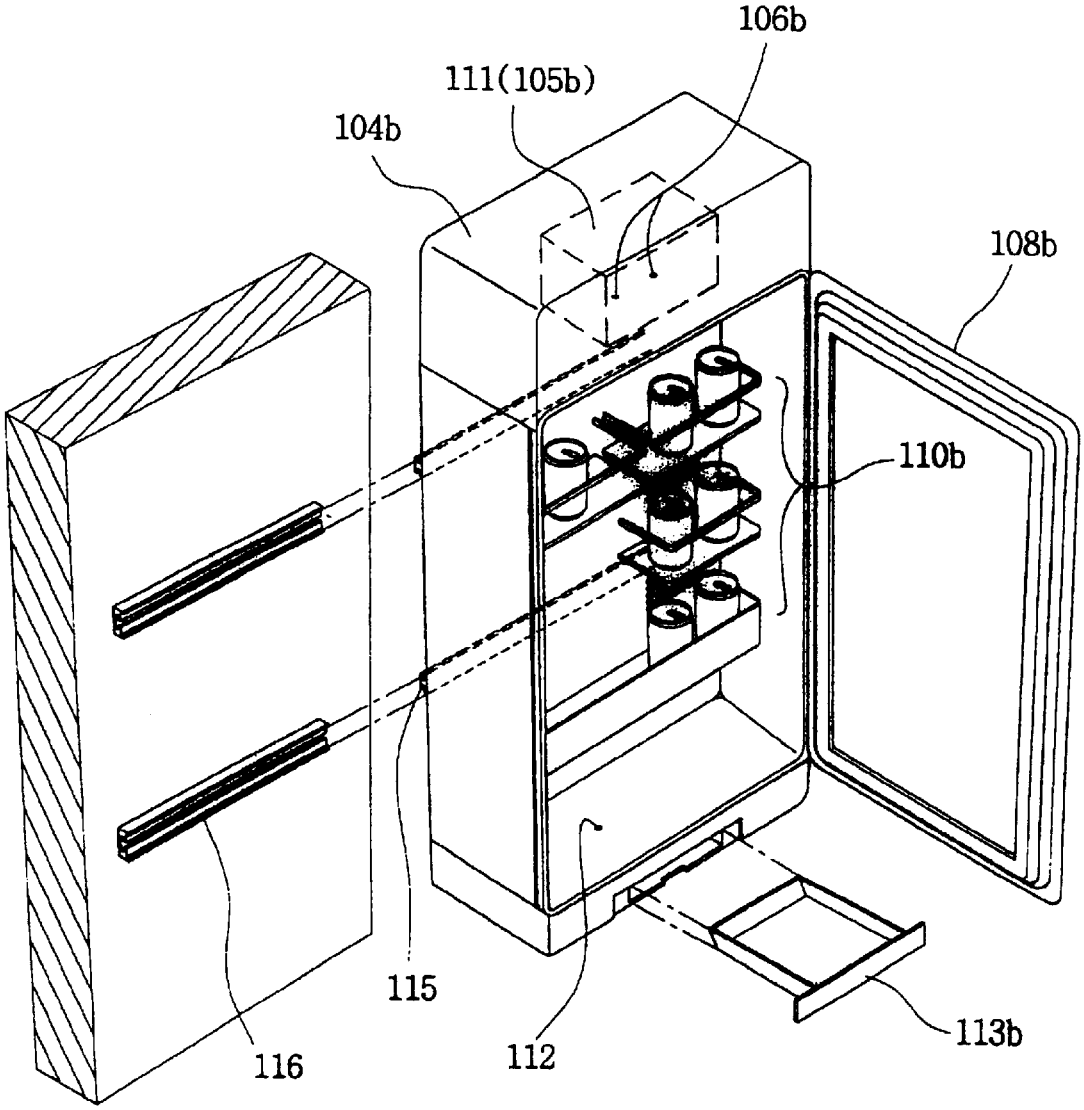
FIG. 8 is a view illustrating a best mode of the property box of a wall-hanging type according to the present invention.

Therefore, the guiding bracket 116 can be installed at any positions of a wall surface in a building as desired by a user. An installation of the property box according to the present invention is then completed by coupling the first fixed bracket 115 with the guiding bracket 116. Applying a power supply to the installed property box operates the second air cooler 105*b* housed/installed on a lower portion of the second housing main body 104 as shown in FIG. 6. Here, a noise generation can be avoided by constituting the second air cooler 105*b* with the cryogenic semiconductor 111 as described above.

Employing the cryogenic semiconductor 111 as the second air cooler 105*b* serves to manufacture the property box in an ultra-slim weight and ultra-slim shape. Thus, no excessive force is laid on the first fixed bracket 115 and the guiding bracket 16, thereby guaranteeing a stability of the property box.

The cool air of the cryogenic semiconductor 111 is discharged to the second cool air discharging outlet 106*b* along the second cool air path 107*b*. The cool air discharged from the plurality of second cool air discharging outlets 106*b* is immediately contacted with the properties received by the third receiving section 110*b* formed in multiple steps. Such an optimal contact of the cool air with the properties serves to prevent a heat loss caused by a suspension and circulation of the cool air.

Further, moisture and water drops formed due to a dew point generated inside of the housing space 102 are guided to the water collecting hole 112 formed on a bottom surface inside of the housing space 102 so as to be collected by the second water collecting section 113*b* installed on a lower portion of the cryogenic semiconductor 111. Therefore, if a predetermined amount of water is collected by the second water collecting section 113*b*, the user simply takes out the second water collection section 113*b* to dispose of the water.

Constructing the second air cooler 105*b* with a compressor, a capillary tube, and a vaporizer serves to circulate a coolant in a predetermined freezing cycle and supply the cool air generated at that time to the housing space 102 of the property box, thereby realizing a storage of the properties under a predetermined temperature.

If the second air cooler 105*b* is housed into an upper portion of the second housing main body 104*b*, the cool air generated from the second air cooler 105*b* is supplied to the housing space 102 through the second cool air discharging outlet 106*b* formed on an upper portion of the second housing main body 104*b*, thereby achieving natural circulation of the cool air. Thus, no separate work performance is required to form the second cool air path 107*b*.

Figure 9:
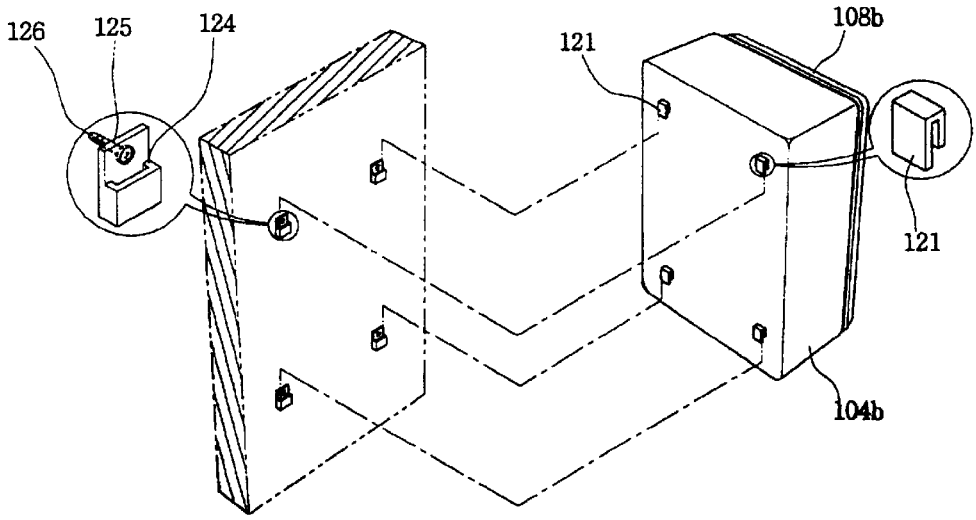
FIG. 9 is a view illustrating another best mode of the property box of a wall-hanging type according to the present invention.

FIG. 9 shows another best mode of the present invention. Referring to FIG. 9, at least one or more latch(es) 121 is (are) attached to a rear surface of the second housing main body. The second fixed bracket 122 is installed to correspond to the latch(es) 121 on a wall surface, on which the second housing main body 104*b* is to be installed. A fixed screw 126 is bolted on the wall surface by means of the aperture 125 formed on the second fixed bracket 122.

Once the second fixed bracket 122 is installed on the wall surface, the latch(es) 121 formed on the rear surface of the second housing main body 104*b* is inserted to the convex groove 126 of the second fixed bracket 122 so that the second housing main body 104*b* can be hung up the second fixed bracket 122.

As shown in FIG. 9, the sliding prevention section 124 is formed on one side of the second fixed bracket 122. Therefore, even if the user radically opens or closes the opening/closing door 108 coupled with the second housing main body 104*b*, the latch(es) 121 is not slid or detached from the second fixed bracket 122.

Figure 10:
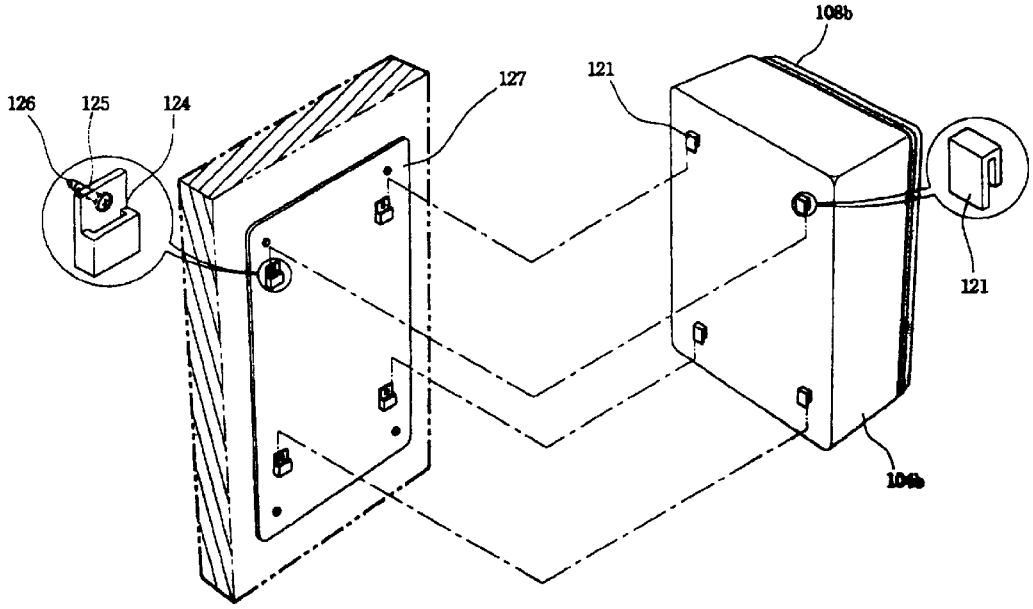
FIG. 10 is a view illustrating another best mode of the property box of a wall-hanging type according to the present invention.

As shown in FIG. 10, it is preferable to attach the second fixed bracket 122 to a plate 127 of a predetermined size so that the second fixed bracket 122 can be steadily located at the position corresponding to the latch(es) 121 attached to the second housing main body 104*b*. Subsequently, the user attaches the plate 127 to the wall surface, and hangs the latch(es) 121 attached to the rear surface of the second housing main body 104*b* on the second fixed bracket 122. The installing process is thus completed in a simple manner.

Figure 11:
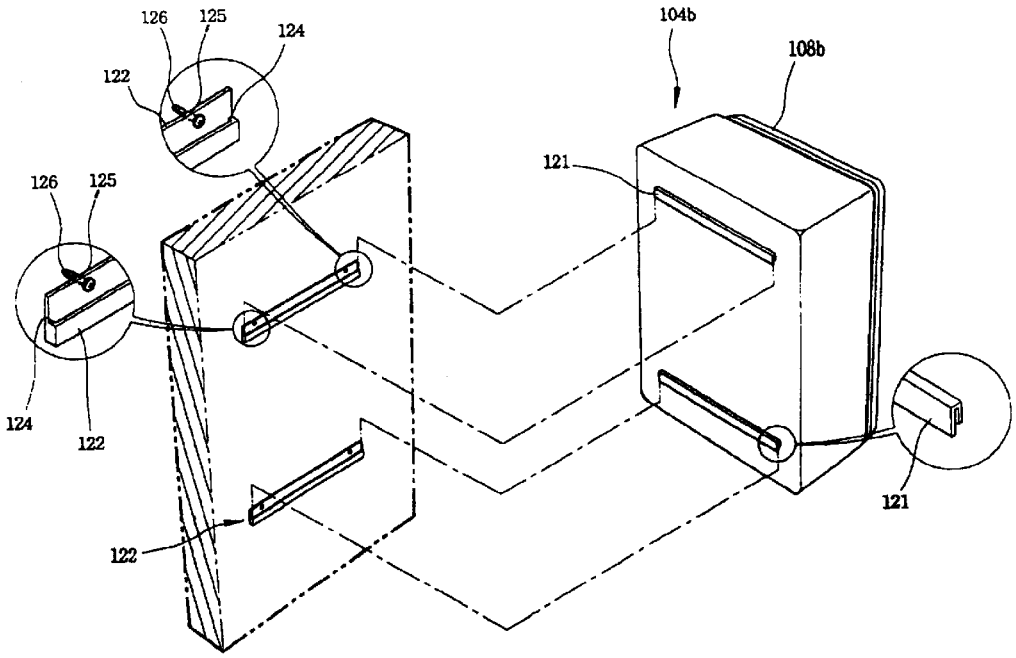
FIG. 11 is a view illustrating another best mode of the property box of a wall-hanging type according to the present invention.

Meanwhile, as shown in FIG. 11, it is preferable to cross-cut the latch(es) 121 formed on the rear surface of the second housing main body 104*b* in a longitudinal direction so as to be easily inserted to the convex groove 126 of the second fixed bracket 122. At that time, it is also preferable to form the second fixed bracket 122 in a length corresponding to the latch(es) 121. It is further preferable to form the sliding prevention section 124 on both end portions of the second fixed bracket 122.

It is also preferable to form a supporting member 128 on either on a lower portion of the rear surface of the second housing main body 104*b* or on the wall surface, with which the second housing main body is in contact, so that the second housing main body 104 can be attached to the wall surface with balance.

Figure 12:
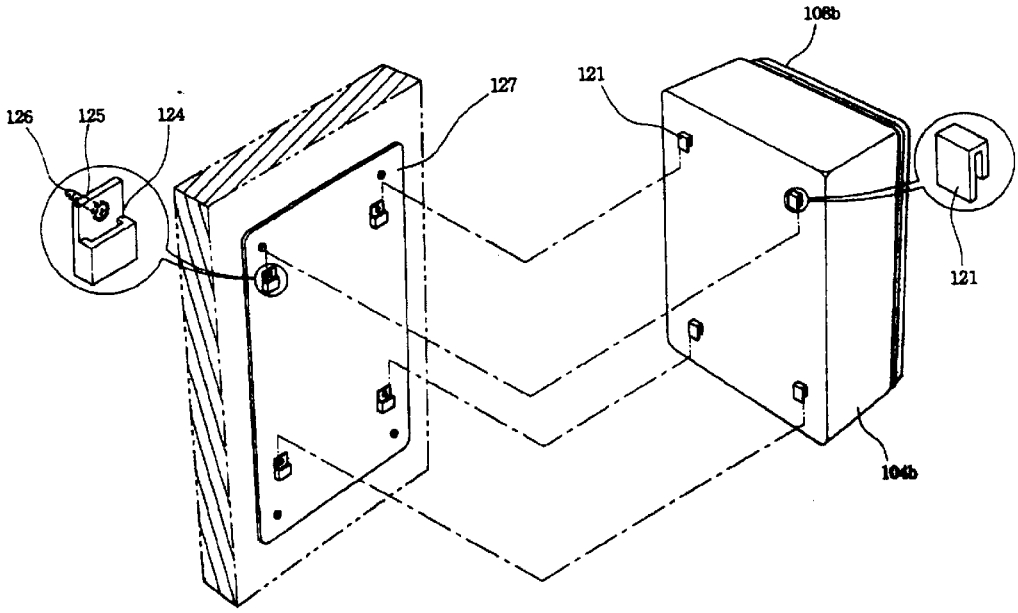
FIG. 12 is a view illustrating another best mode of the property box of a wall-hanging type according to the present invention.
Figure 13:
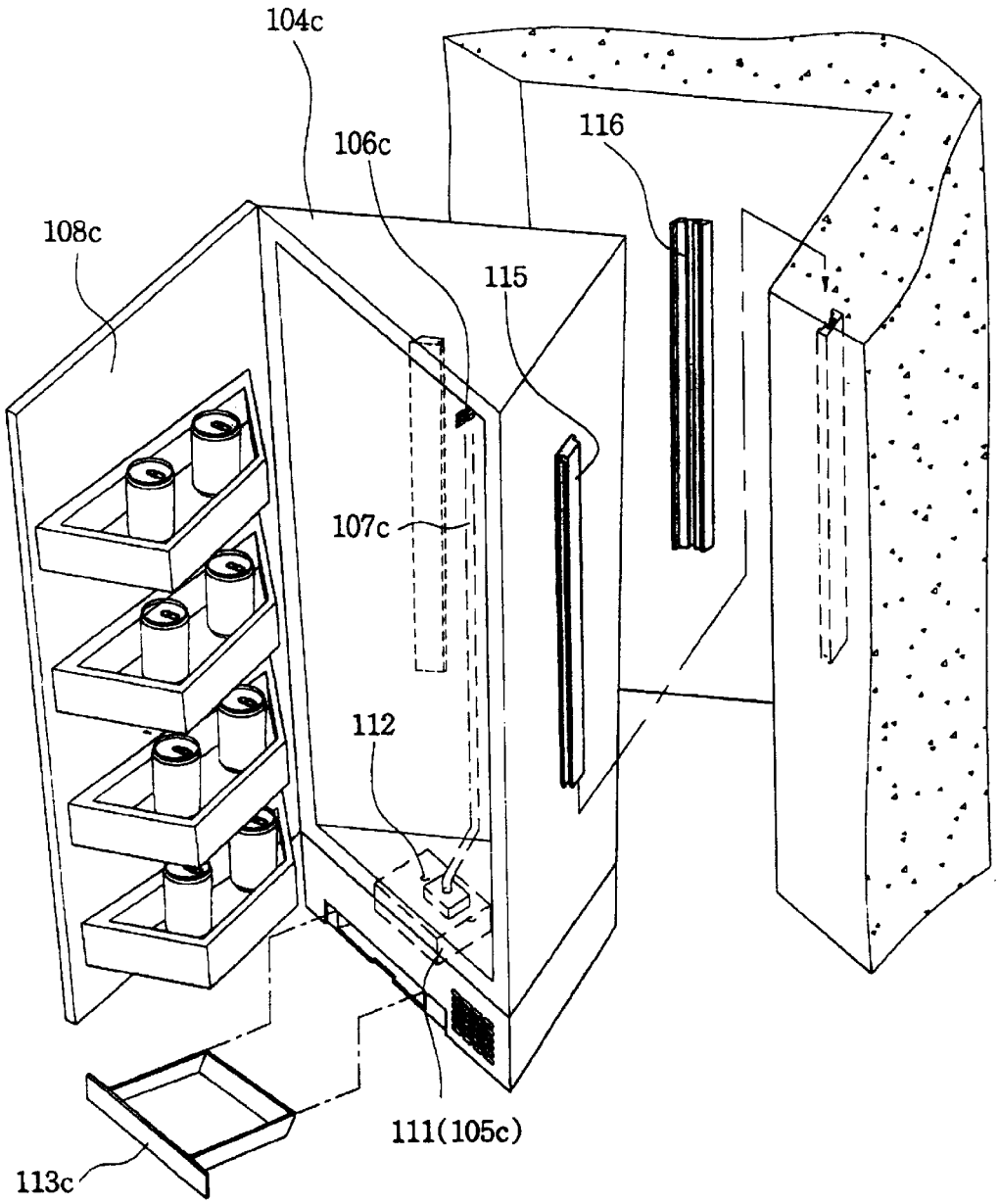
FIG. 13 is a view illustrating another best mode of the property box of a cabinet type according to the present invention.
Figure 14:
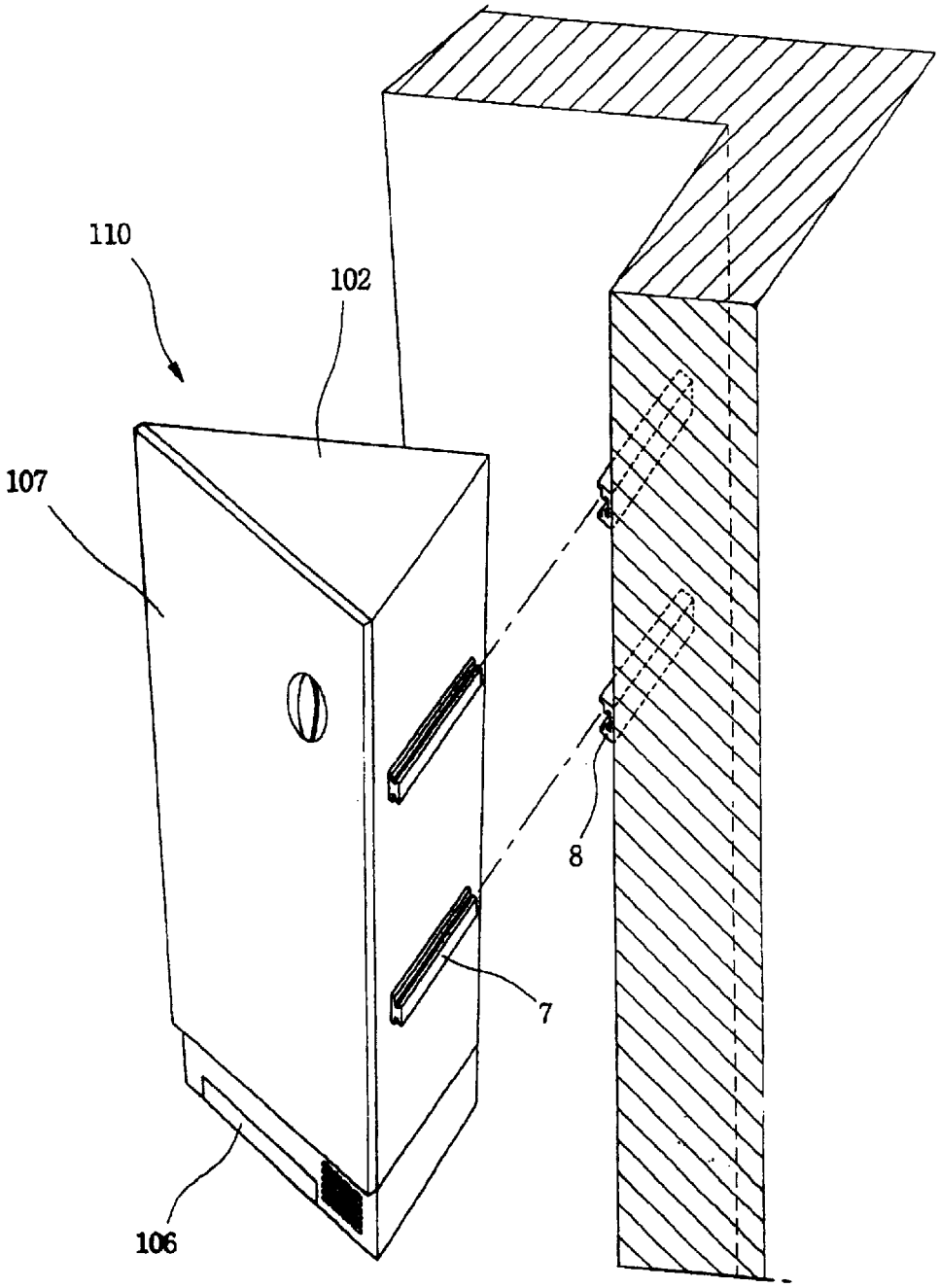
FIG. 14 is a view illustrating another best mode of the property box of a cabinet type according to the present invention.

FIGS. 12 and 13 show another best mode of the present invention. Referring to FIGS. 12 and 13, the third housing main body 104 is formed in a triangular shape so as to be coupled with the corner, at which two wall surfaces of an existing building encounter. At least one or more first fixed bracket(s) 115 is (are) formed on both rear surfaces of the third housing main body 104*c*. The guiding bracket 116 is attached to the corner of the wall either in a vertical direction or in a horizontal direction so as to correspond to the first fixed bracket(s) 115.

Thus, the corner of the wall, which is rarely used, becomes effectively available by slidably inserting the first fixed bracket 115 of the third housing main body 104*c* to the guiding bracket 116 attached to the corner of the wall.

Of the drawings reference numerals not referred to above, 108*c* represents a third opening/closing door, while 113*c* represents a third water collecting section.

As described above, the present invention provides advantages of not only making available of a property box while protecting one's private life in a shared living space but also maximizing the living space and minimizing a constraint in activity by installing the property box on a wall surface or at a corner of the wall. The present invention also provides an advantage of enhancing the life cycle of the property box by preventing a shock to be laid on the air cooler even with frequent opening and closing.

What is claimed is:

1. A property box of a cabinet type requiring low temperature, comprising:

a cabinet frame of a predetermined size formed on a wall surface of a living space including an apartment, an ordinary house or a lodging;

a first housing main body having a housing to be inserted to the cabinet frame, a predetermined housing space, and an exit;

a first air cooler housed in the predetermined space of a lower portion of the first housing main body to generate low temperature;

a first cool air path for linking at least one or more first cool air discharging outlet(s) formed on an inner wall of the housing space to supply the cool air generated from the first air cooler to the housing space and the first air cooler; and a first opening/closing door rotatably hinge-coupled with the exit of the first housing main body and having a first receiving section for receiving predetermined properties inside thereof.

2. The property box of claim 1, wherein the first air cooler includes a cryogenic semiconductor operated by a power supply applied from a power supply section for generating cool and hot air.

3. The property box of claim 1, wherein the first air cooler includes a compressor, capillary tube, and a vaporizer for circulating a coolant in a predetermined freezing cycle.

4. The property box of claim 1, further comprising at least one or more first receiving shelf(ves) attachably and detachably installed on a front surface of an external side of the first opening/closing door for receiving predetermined properties.

5. The property box of claim 1, further comprising a second receiving section installed within the housing space for receiving the predetermined properties to be in optimal contact with the cool air discharged from the first cool air discharging outlet of the first housing main body.

6. The property box of claim 1, further comprising a first water collecting section slidably coupled with a lower portion of the first air cooler for guiding and collecting water generated within the first air cooler and the housing space to a water collecting hole.

7. The property box of claim 1, further comprising an external casing fixedly inserted to the cabinet frame and fixedly coupled with the first housing main body inserted to the housing space inside of the cabinet frame.

8. The property box of claim 7, further comprising a rib formed either on an external side surface or on a rear surface of the external casing with a predetermined thickness.

9. The property box of claim 1, wherein the first air cooler is housed in a predetermined region of an upper portion of the first housing main body so that the cool air generated from the first air cooler can be circulated in the housing space in a convection manner.

10. A property box of a wall-hanging type, comprising:

a second housing main body having a predetermined housing space and an exit;

a second air cooler coupled in the predetermined space of a lower portion of the second housing main body to generate low temperature;

a second cool air path for linking at least one or more second cool air discharging outlet(s) formed on an inner wall of the housing space to supply the cool air generated from the second air cooler to the housing space and the second air cooler; and a second opening/closing door rotatably hinge-coupled with the exit of the second housing main body and having a first receiving section for receiving predetermined properties inside thereof;

a first fixed bracket of "I" shape attached to a rear surface of the second housing main body and formed in a longitudinal direction; and a guiding bracket attached to a wall surface and having a concave groove in a longitudinal direction so that the first fixed bracket can be slidably coupled therewith in concave and convex manner.

11. The property box of claim 10, wherein the second air cooler includes a second cryogenic semiconductor operated by a power supply applied from a power supply section for generating cool and hot air.

12. The property box of claim 10, wherein the second air cooler includes a compressor, capillary tube, and a vaporizer for circulating a coolant in a predetermined freezing cycle.

13. The property box of claim 10, further comprising a third receiving section installed within the housing space for receiving the predetermined properties to be in optimal contact with the cool air discharged to the second cool air discharging outlet(s) of the second housing main body.

14. The property box of claim 10, further comprising a second water collecting section slidably coupled with a lower portion of the second air cooler for guiding and collecting water generated from the housing space of the second air cooler to a water collecting hole.

15. The property box of claim 10, wherein the second air cooler is housed within a predetermined upper portion of the second housing main body for circulating the cool air generated from the second air cooler in the housing space in a convection manner.

16. The property box of claim 10, further comprising:

at least one or more latch(es) formed on at least on an upper or on a lower portion of the rear surface of the second housing main body integrally or separately; and a second fixed bracket bolted and attached to the wall surface by means of a fixed screw to correspond to the latch(es) and having an upward concave groove so that the latch(es) can be hung up on the wall.

17. The property box of claim 10, further comprising a plate of a predetermined size having at least one or more second fixed bracket(s).

18. The property box of claim 16, further comprising a sliding prevention section formed on either one side of the second fixed bracket so that the latch(es) coupled with the second fixed bracket may not be slid toward either one side thereof.

19. The property box of claim 16, wherein the latch(es) formed on the second main body is cross-cut in a longitudinal direction.

20. The property box of claim 19, wherein the second fixed bracket is cross-cut in a longitudinal direction to correspond to the latch(es).

21. The property box of claim 16, further comprising at least one or more supporting member(s) formed either on a lower portion of the rear surface of the second housing main body or on a wall surface, on which the second housing main body is contacted.

22. A property box of a wall-hanging type requiring low temperature, comprising:

a third housing main body having a predetermined housing space in a triangular shape and an exit on a front surface thereof;

a third air cooler coupled with a predetermined region of a lower portion of the third housing main body for generating low temperature;

a third cool air path for linking a third cool air discharging outlet formed on an inner side wall of the housing space to supply the cool air generated from the third air cooler to the housing space with the third air cooler;

a third opening/closing door rotatably hinge-coupled with the exit of the third housing main body and having a fourth receiving section to receive predetermined properties;

a first fixed bracket of "I" shape attached to a predetermined position of both side surfaces of a rear section of the third housing main body either in a horizontal direction or a vertical direction in a longitudinal direction; and a guiding bracket attached to a corner of the wall with a predetermined distance therefrom and having a concave groove so that the first fixed bracket can be slidably coupled in concave and convex manner.

* * * * *